US009794660B2

(12) United States Patent
Rittenhouse

(10) Patent No.: US 9,794,660 B2
(45) Date of Patent: Oct. 17, 2017

(54) INTEGRATED SOUND BAR HINGE ASSEMBLY FOR MOBILE ELECTRONIC DEVICE

(71) Applicant: Intel Corporation, Santa Clara, CA (US)

(72) Inventor: David A. Rittenhouse, Fair Oaks, CA (US)

(73) Assignee: INTEL CORPORATION, Santa Clara, CA (US)

( * ) Notice: Subject to any disclaimer, the term of this patent is extended or adjusted under 35 U.S.C. 154(b) by 17 days.

(21) Appl. No.: 14/866,468

(22) Filed: Sep. 25, 2015

(65) Prior Publication Data

US 2017/0094380 A1 Mar. 30, 2017

(51) Int. Cl.
*H04R 9/06* (2006.01)
*H04R 1/02* (2006.01)

(52) U.S. Cl.
CPC ..... *H04R 1/02* (2013.01); *H04R 2499/11* (2013.01)

(58) Field of Classification Search
CPC ..... H04R 1/02; H04R 1/025; H04R 1/2803; H04R 2499/11
USPC ..... 381/334
See application file for complete search history.

(56) References Cited

U.S. PATENT DOCUMENTS

| | | | | |
|---|---|---|---|---|
| 5,838,537 | A | 11/1998 | Lundgren et al. | |
| 5,917,695 | A * | 6/1999 | Youn | G06F 1/1616 345/905 |
| 6,078,497 | A | 6/2000 | Derocher et al. | |
| 6,246,570 | B1 * | 6/2001 | Kim | G06F 1/1616 361/679.23 |
| 9,107,301 | B2 * | 8/2015 | Pan | H05K 5/0226 |
| 9,268,371 | B2 * | 2/2016 | Chen | G06F 1/1618 |
| 2007/0279857 | A1 | 12/2007 | Sun | |
| 2013/0170124 | A1 | 7/2013 | Pan et al. | |
| 2014/0307906 | A1 * | 10/2014 | So | H04R 1/028 381/334 |
| 2016/0010375 | A1 | 1/2016 | Rittenhouse | |

FOREIGN PATENT DOCUMENTS

KR 20-0404505 12/2005

OTHER PUBLICATIONS

International Search Report and Written Opinion for PCT Patent Application No. PCT/US16/45406 mailed Nov. 16, 2016, 16 pgs.

* cited by examiner

*Primary Examiner* — Van D Huynh
(74) *Attorney, Agent, or Firm* — Blakely Sokoloff Taylor and Zafman LLP

(57) ABSTRACT

Embodiments are generally directed to an integrated sound bar hinge assembly for a mobile electronic device. A wearable electronic device may include a hinge assembly body; at least one hinge set coupled with hinge assembly body to hingeably couple a first portion of a mobile device to a second portion of the mobile device; and at least one speaker bracket contained in the hinge assembly body to install a first speaker.

14 Claims, 6 Drawing Sheets

INTEGRATED SOUND BAR HINGE ASSEMBLY FOR MOBILE ELECTRONIC DEVICE

TECHNICAL FIELD

Embodiments described herein generally relate to the field of electronic devices and, more particularly, to an integrated sound bar hinge assembly for a mobile electronic device.

BACKGROUND

Mobile electronic devices, including laptop, notebook, and convertible computers, generally include speakers to produce sound for a user. However, the audio produced by the speakers is commonly poor in quality.

Mobile electronic devices have a limited amount of space for components, and the limited space is increasingly needed for the battery as the devices have become thinner and as consumers have demanded improved battery life, which can in part be provided by a larger battery pack. Thus, the speakers in such devices may be very small and incapable of producing much sound volume.

Further, speakers are often poorly located in mobile electronic devices, with the placement being inadequate for sound projection and potentially being blocked when the device is in use, then further reducing the quality of the sound heard by a user of such device.

BRIEF DESCRIPTION OF THE DRAWINGS

Embodiments described here are illustrated by way of example, and not by way of limitation, in the figures of the accompanying drawings in which like reference numerals refer to similar elements.

DETAILED DESCRIPTION

Figure 1A:
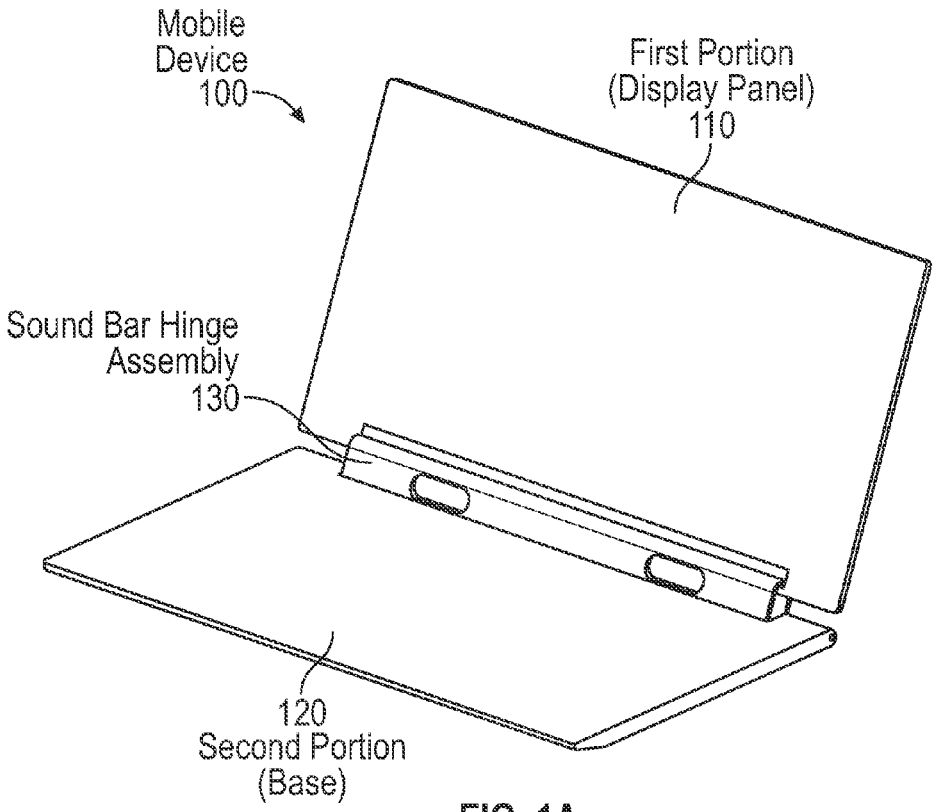
FIG. 1A is an illustration of a mobile device including a sound bar hinge assembly according to an embodiment.

Embodiments described herein are generally directed to an integrated sound bar hinge assembly for a mobile electronic device.

For the purposes of this description:

"Mobile electronic device" or "mobile device" means a notebook or laptop computer, a convertible computer, a handheld computer, a mobile Internet device, or other mobile electronic device that includes processing and image presentation capability.

"Convertible device" means a mobile device that may be converted into multiple positions or orientations for use, such a convertible computer allowing conversion into both a laptop or notebook computer position and as a tablet computer position.

"Speaker" means a device that converts audio signals into air vibrations to produce audible sound. A speaker may also be referred to an audio transducer or similar term.

In some embodiments, an apparatus or system includes one or more one or more speakers or speaker brackets incorporated into a sound bar hinge assembly, wherein the sound bar is incorporated into or coupled with a hinge assembly for a mobile device. In some embodiments, speakers are installed in a hinge assembly that hingeably or moveably couples a first portion and a second portion of a mobile device, the speakers thus being removed from the first and second portions of the mobile devices. In some embodiments, an integrated sound bar hinge assembly includes a hinge assembly body or cover; one or more hinge sets coupled with the body or cover; and one or more speakers or speaker brackets in the body or cover.

As mobile devices are designed to extend the operation of such devices, such devices utilize more and more space for batteries or other power storage. However, the result of such configuration is that there is less space for speakers and similar components. As a result, smaller speakers are utilized. Further, the placement of speakers is increasingly difficult, which adds to the difficulty in generating acceptable audio from a mobile device. In some embodiments, a sound bar hinge assembly for a mobile device may allow for incorporation of larger speakers, depending on the particular bar, than is possible in conventional configurations. Such placement may thus provide for sound volume and improved sound quality with larger speakers, and further provide for better back volume, which can improve sound quality even if existing speakers are utilized. Further, the removal of speakers from a portion of a mobile device allows additional volume for other components.

Further, the installation of a sound bar incorporated into or coupled with a hinge assembly allows for directing speakers in a direction directed towards a user in a hinge of a clamshell device such as a laptop or notebook computer. Such an implement provides an improved positioning of speakers with relation to a user in comparison with a conventional installation of speakers in a mobile device as the speakers are directed at the user. In addition, speaker bar hinge assembly may allow for improved sound quality in a convertible mode in which the speakers may be directed at a different angle in relation to a user.

In addition to other issues, speaker placement in a base assembly of a conventional mobile device such as laptop or notebook computer can result in blockage of speakers by the hands of a user as the user operates the mobile device. In some embodiments, the placement of speakers in a sound bar hinge assembly of the mobile device may be utilized to improve sound dispersion because there generally is little or no blockage of the speakers by the users' hands in the operation of the mobile device. Further, the transference of speakers for a particular mobile device implementation from a base assembly into a speaker bar hinge assembly eliminates the necessity for installation of speaker grills in the base assembly or display panel assembly of the mobile device.

In some embodiments, a sound bar hinge assembly allows for installation or replacement of the sound bar or of speakers within the sound bar, thus enabling the installation of speakers for purposes of upgrading a system without re-tooling the base of the system. Such implementation may allow for purchasing speakers for a computer in the resale market, and allow for manufacturers to provide options for upgrading system speakers with the sale of a computer systems In some embodiments, a sound bar hinge assembly includes one or more hollow axles, which allow for running cables for speakers through such axles, such as cables installed between a base assembly and the speakers of the sound bar. In some embodiments, one or more cables are connected to a speaker or speaker bracket to carry audio signals to the speaker or speaker bracket.

In some embodiments, a sound bar hinge assembly includes a hinge synchronization bar. In some embodiments, a sound bar is incorporated into the hinge synchronization bar to utilize the bar for sound production.

FIG. 1A is an illustration of a mobile device including a sound bar hinge assembly according to an embodiment. In some embodiments, a mobile device 100 (which may be, but is not limited to, a computing device such as a laptop or notebook computer) includes a first portion 110, which may include but is not limited to a display panel assembly, and a second portion 120, which may include but is not limited to a base assembly, wherein the first portion and second portion are hingeably coupled together with a sound bar hinge assembly 130. In some embodiments, a sound bar is incorporated into the hinge assembly 130. In some embodiments, a sound bar is coupled with the hinge assembly.

In some embodiments, the first portion and second portion each have a first side, which may be referred to as front (or top) side, and a second side, which may be referred to as a back (or bottom side). As illustrated, the mobile device is in a position that may be referred to as a "laptop position", in which the front side of the first portion 110 is generally facing a user of the device and the front side of the second portion 120 is generally facing upward. Other positions of the mobile device may include a "closed position", in which the first portion 110 and second portion 120 are arranged such the first portion and second portion are parallel to each other with the front side of the first portion facing the front side of the second portion (i.e., the first portion 110 faces a first direction and the second portion 120 faces a second opposite direction); a "fully open position" in which the first portion 110 and second portion 120 are arranged such front side of the first portion and the front side of the second portion generally face a same direction (such as in circumstances in which the first portion and the second portion both contain display screens and both may face a user at the same time); and a "tablet position" in which the first portion 110 and second portion 120 are arranged such the first portion and second portion are parallel to each other with the back side of the first portion either facing the back side of the second portion or (if the second portion can be turned around on another axis) facing the front side of the second portion, and thus at least the front side of the first portion being viewable by a user.

In some embodiments, the sound bar hinge assembly 130 includes one or more speakers (or one or more brackets to install speakers) that are electrically connected to the first portion 110 or second portion 120 of the mobile device 100 by one or more wires or cables (referred to here in general as cables) to produce sound for the mobile device. In some embodiments, the first portion 110 and second portion 120 of the mobile device do not contain any speakers, thus providing additional interior volume for installation of other components.

Figure 1B:
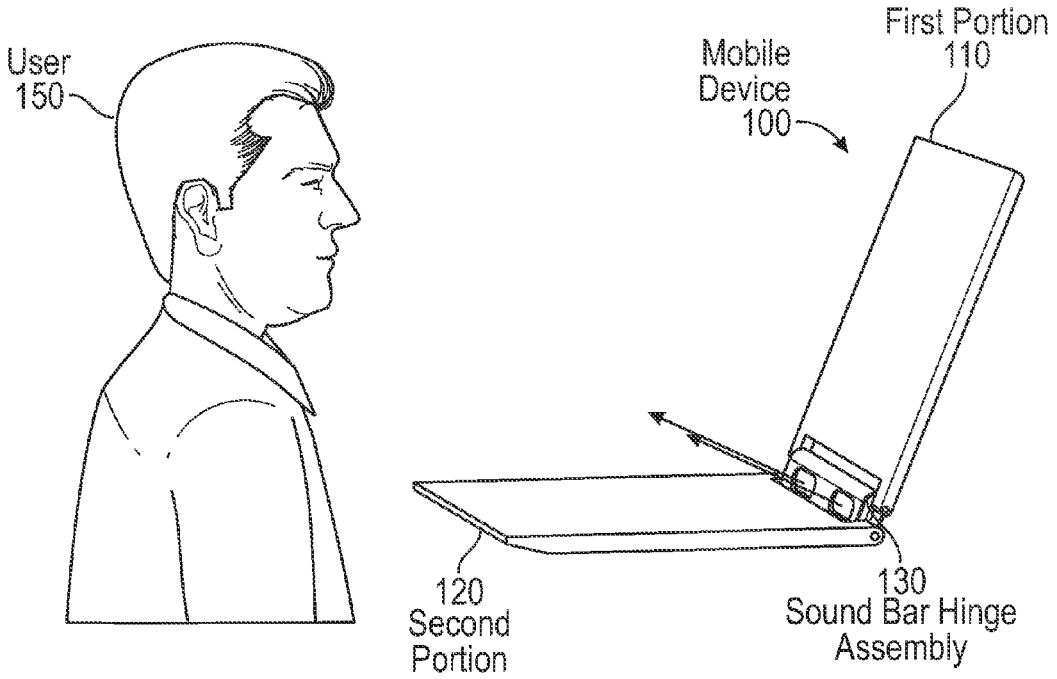
FIG. 1B is side view of a mobile device including a sound bar hinge assembly according to an embodiment.

FIG. 1B is side view of a mobile device including a sound bar hinge assembly according to an embodiment. In the illustration provided in FIG. 1B, the sound bar hinge assembly 130, which couples the first portion 110 and the second portion 120 of the mobile device together, is oriented such that the one or more speakers to be installed in the sound bar hinge assembly face towards a user 150 when operating the mobile device 100, and thus sound produced by the one or more speakers is directed towards the user 150.

Figure 2:
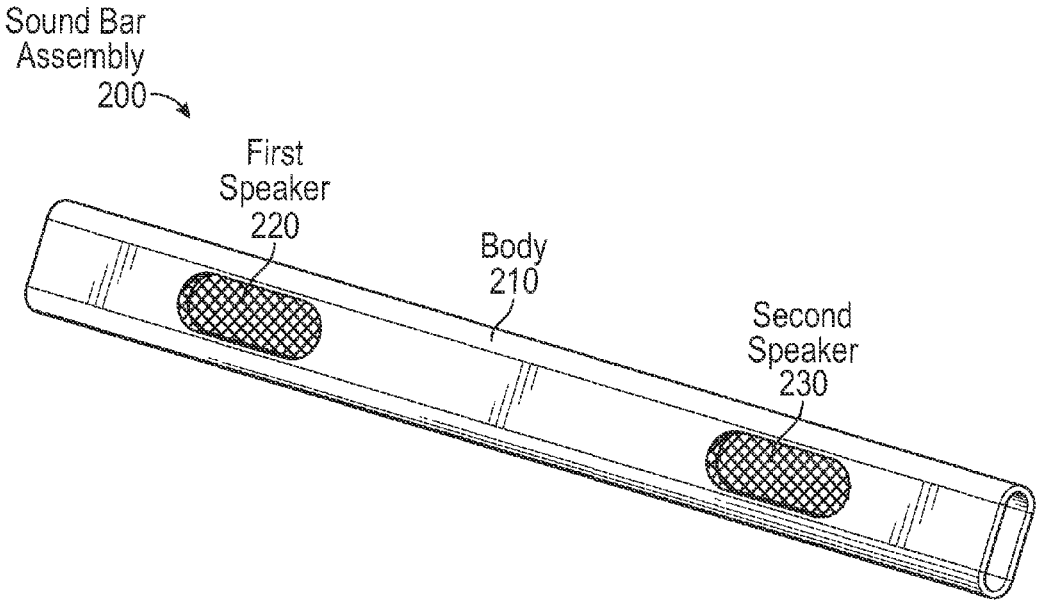
FIG. 2 is an illustration of a sound bar for implementation in a mobile device according to an embodiment.

FIG. 2 is an illustration of a sound bar assembly for implementation in a mobile device according to an embodiment. In some embodiments, a sound bar assembly 200 is incorporated into or may be coupled with a hinge assembly of a mobile electronic device, such as, for example, mobile device 100 illustrated in FIGS. 1A and 1B.

In some embodiments, the sound bar assembly includes a body or cover 210 and one or more speakers, such as a first speaker 220 and a second speaker 230. In some embodiments, the first speaker 220 and second speaker 230 are to be electrically connected to at least one portion of a mobile device via one or more cables to produce audio for the mobile device.

Figure 3:
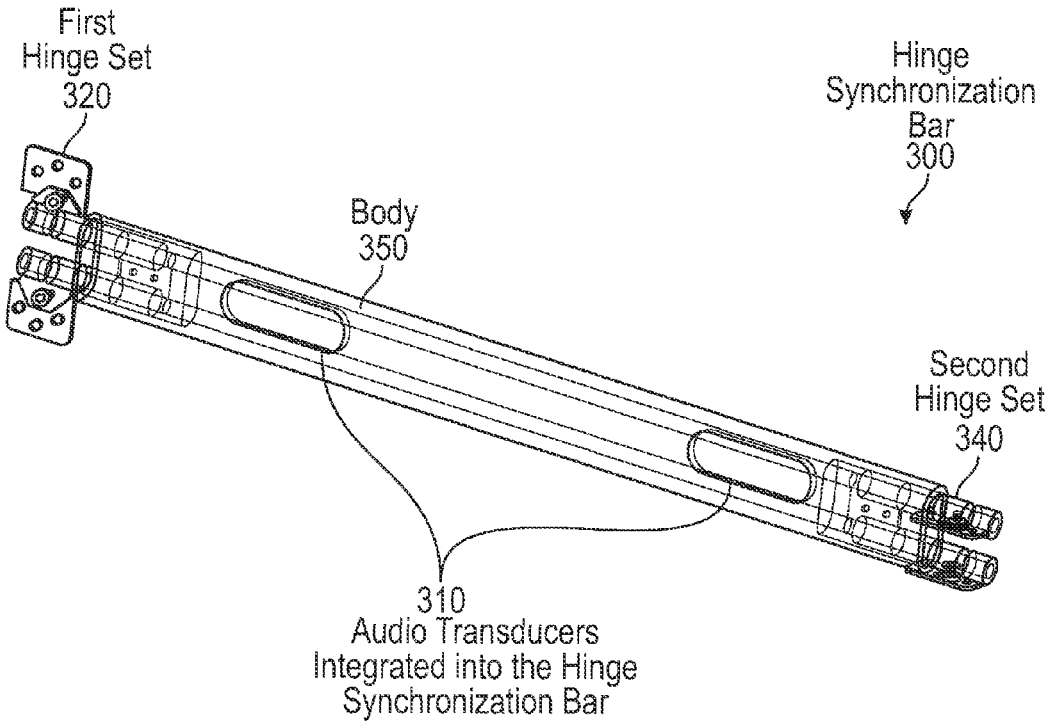
FIG. 3 is an illustration of hinge synchronization bar including audio transducers according to an embodiment.

FIG. 3 is an illustration of hinge synchronization bar including audio transducers according to an embodiment. In some embodiments, a hinge synchronization bar includes one or more audio transducers or brackets for audio transducers 310. In some embodiments, the hinge synchronization bar includes at least one hinge set, such as a first hinge set 320 and a second hinge set 340. Further, each hinge set includes at least a first hinge and a second hinge, each hinge including an attachment bracket and an axle. Further, the hinge synchronization bar 300 includes a body 350, to which the hinge sets are coupled. As illustrated, the hinges of the first hinge set 320 are in a fully open position, and the hinges of second hinge set 340 are in a closed position or (if turned a full rotation) in a tablet position (or tablet computer position). It is noted that the different hinge positions are provided for illustration, and that that, if installed in a mobile device, the hinges of the first hinge set 320 and the hinges of the second hinge set 340 would generally be in the same position.

In some embodiments, an axle of each hinge of a hinge set is enclosed at least in part by the body 350. In some embodiments, the hinge synchronization bar is to be coupled with a first portion and a second portion of a mobile device (such as first portion 110 and second portion 120 illustrated in FIGS. 1A and 1B) utilizing the first hinge set 320 and second hinge set 340 to hingeably couple the first and second portions together. For example, a first attachment bracket of a first hinge set and a first attachment bracket of a second hinge set are to be coupled with a first portion of a mobile device, and a second attachment bracket of the first hinge set and a second attachment bracket of the second hinge set are to be coupled with a second portion of the mobile device.

In some embodiments, the hinge synchronization bar allows for a certain amount of rotation. In some embodiments, the hinge synchronization bar may allow for, for example, 360° (360 degrees) of rotation. Such a structure allows, for example, a panel section of a convertible system to rotate all the way around 360° from a closed position into a tablet position. In some embodiments, a ball detent or similar element may to hold a first hinge stationary in relation to the associated axle while a portion of the device, such as a display panel, attached to another hinge rotates a full 180°. In some embodiments, for such an implementation, moving the display panel further will overcome the detent force and the additional 180° rotation may be achieved. In this manner, the hinge synchronization bar may remain in a certain orientation with a base portion of the device as the display portion is rotated open.

In some embodiments, each hinge set includes hinge brackets for attachment to a first portion and a second portion of a mobile device. Each hinge bracket includes a front side and a back side, wherein, when connected to a portion of the mobile device, the front side of a hinge bracket faces a same direction as a front side of the portion to which the hinge bracket is attached. Further, the hinge synchronization bar includes a front side and a back side, with the audio transducers or brackets installed in the front side of the synchronization bar, wherein the front side of the hinge synchronization bar is to be oriented such that sound is directed towards a user in a position such as illustrated in FIG. 2B.

Thus, in an example, if the mobile device is in a fully open position, a front side of the first portion, a front side of the second portion, and a front side of the hinge synchronization bar, including any audio transducer or bracket, are each facing generally in a same direction.

Figure 4A:
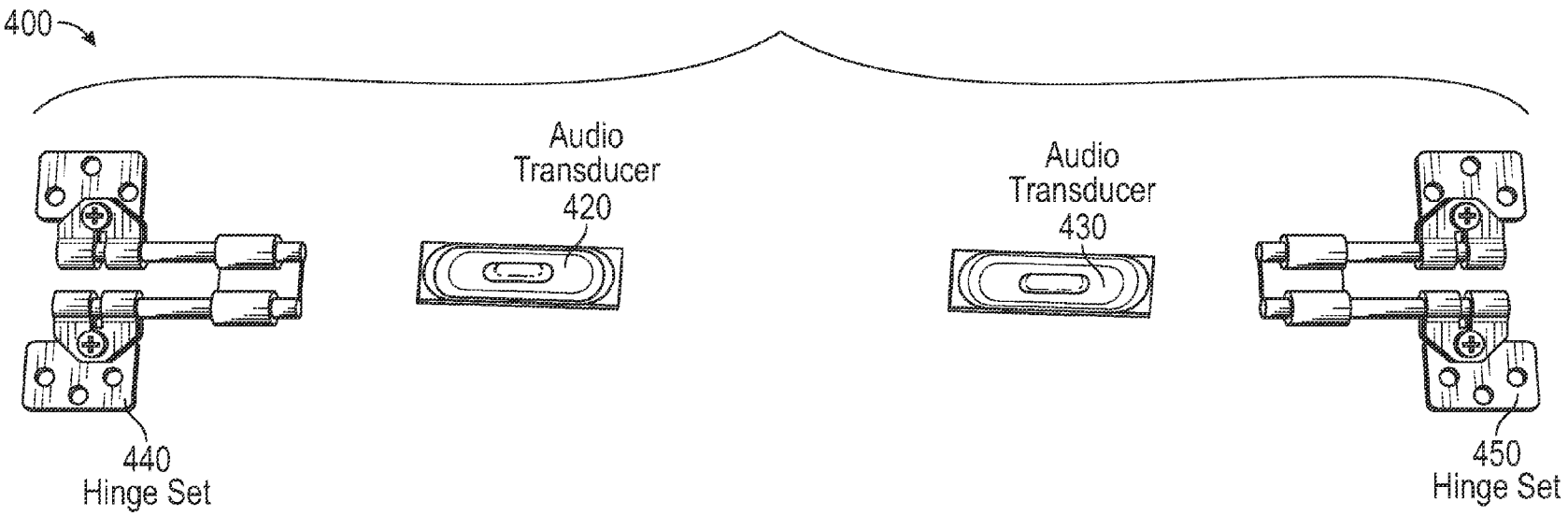
FIG. 4A is an illustration of components of a sound bar hinge assembly according to an embodiment.

FIG. 4A is an illustration of components of a sound bar hinge assembly according to an embodiment. In some embodiments, a sound bar hinge assembly 400 (such as, for example, sound bar hinge assembly 130 illustrated in FIGS. 1A and 1B) includes at least one or more audio transducers, such as a first audio transducer 420 and a second audio transducer 430, and one or more hinge sets, such as a first hinge set 440 and a second hinge set 450. In some embodiments, the illustrated components are coupled with a body or cover in an integrated hinge assembly.

Figure 4B:
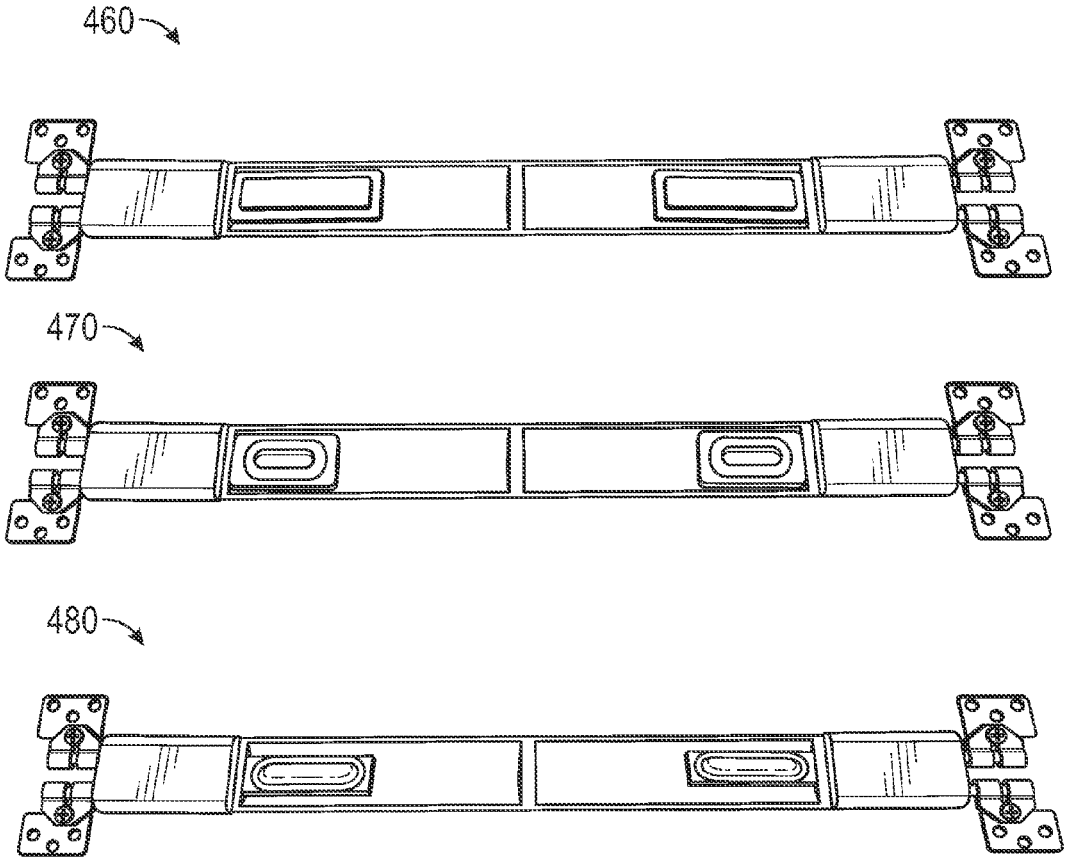
FIG. 4B is an illustration of implementations of a sound bar hinge assembly according to an embodiment.

FIG. 4B is an illustration of implementations of a sound bar hinge assembly according to an embodiment. As shown, a first implementation 460 includes a first variety of audio transducers, a second implementation 470 includes a second variety of audio transducers, and a third implementation 480 includes a third variety of audio transducers. Two audio transducers to provide stereo audio output may commonly be utilized. However, embodiments are not limited to the illustrated implementations, and may include one or more of any speaker size and shape that can be installed in the physical space of the sound bar.

Figure 5A:
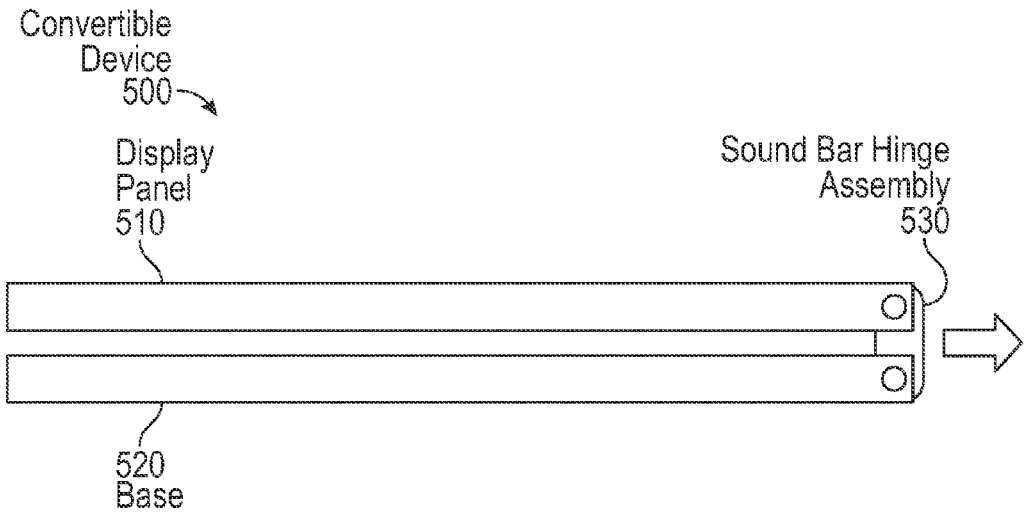
FIG. 5A is an illustration of an end view of a convertible computer including a sound bar hinge assembly according to embodiment.

FIG. 5A is an illustration of an end view of a convertible device including a sound bar hinge assembly according to embodiment. In some embodiments, a convertible device 500 that may be converted into multiple positions includes a sound bar hinge assembly 530 to hingeably couple a first portion, such as a display panel 510, and a second portion 520, such as a base, of the convertible device 500 together.

In some embodiments, when the convertible device 500 is in a tablet position (with, for example, the display panel 510 oriented to point upward in the illustration) such as shown in FIG. 5A, the sound bar hinge assembly 530 may oriented to produce audio that is directed in a side direction. Stated in another way, in the tablet position, the sound bar hinge assembly 530 and the audio produced by speakers located in such assembly is oriented in a direction that is parallel to the front side of the display panel 510. While such orientation would not generally be in position to direct audio towards a user of the device 500, installed audio transducers in the device 500 can still provide good audio quality for the user of the device in the tablet position.

Figure 5B:
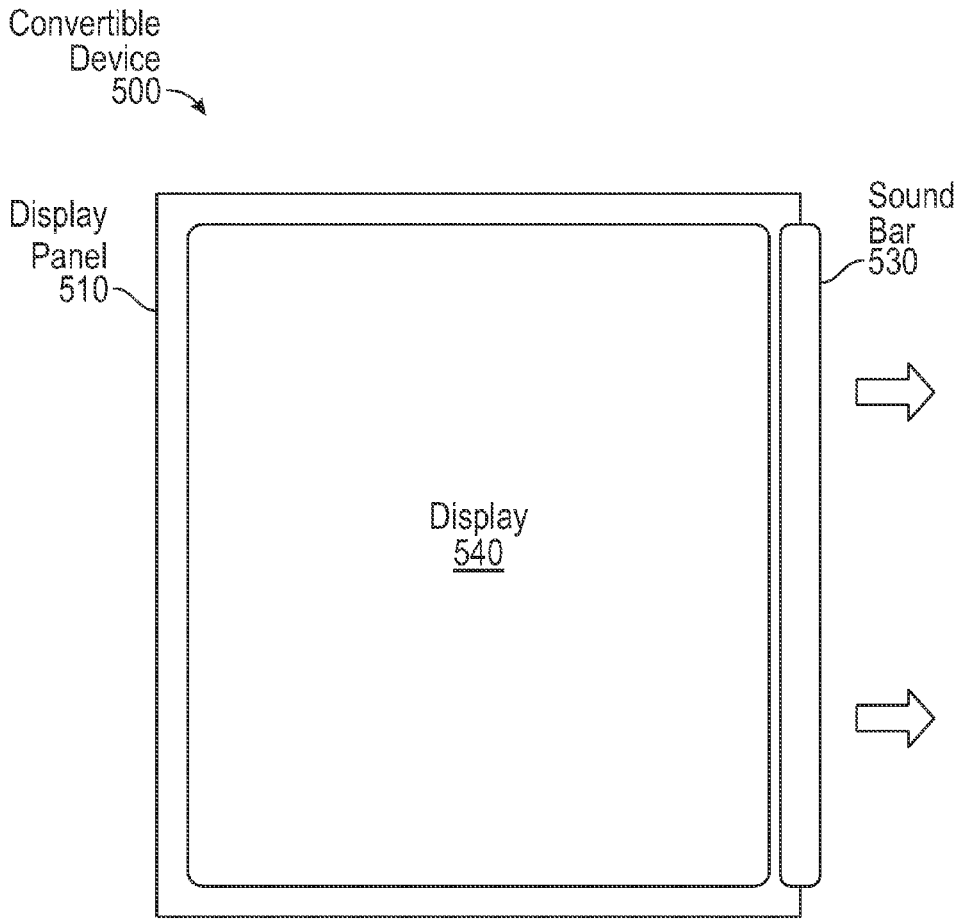
FIG. 5B is an illustration of an front view of a convertible computer including a sound bar hinge assembly according to embodiment.

FIG. 5B is an illustration of a front view of a convertible computer including a sound bar hinge assembly according to embodiment. In some embodiments, a convertible device 500 that may be converted into multiple positions includes a sound bar hinge assembly 530 to hingeably couple a first portion, such as a display panel 510, and a second portion 520, such as a base, of the convertible device 500 together.

In some embodiments, when the convertible device 500 is in a tablet position such as shown in FIG. 5B, the sound bar hinge assembly 530 may oriented to produce audio that is directed in a side direction, parallel to the front side of the display panel.

Figure 6:
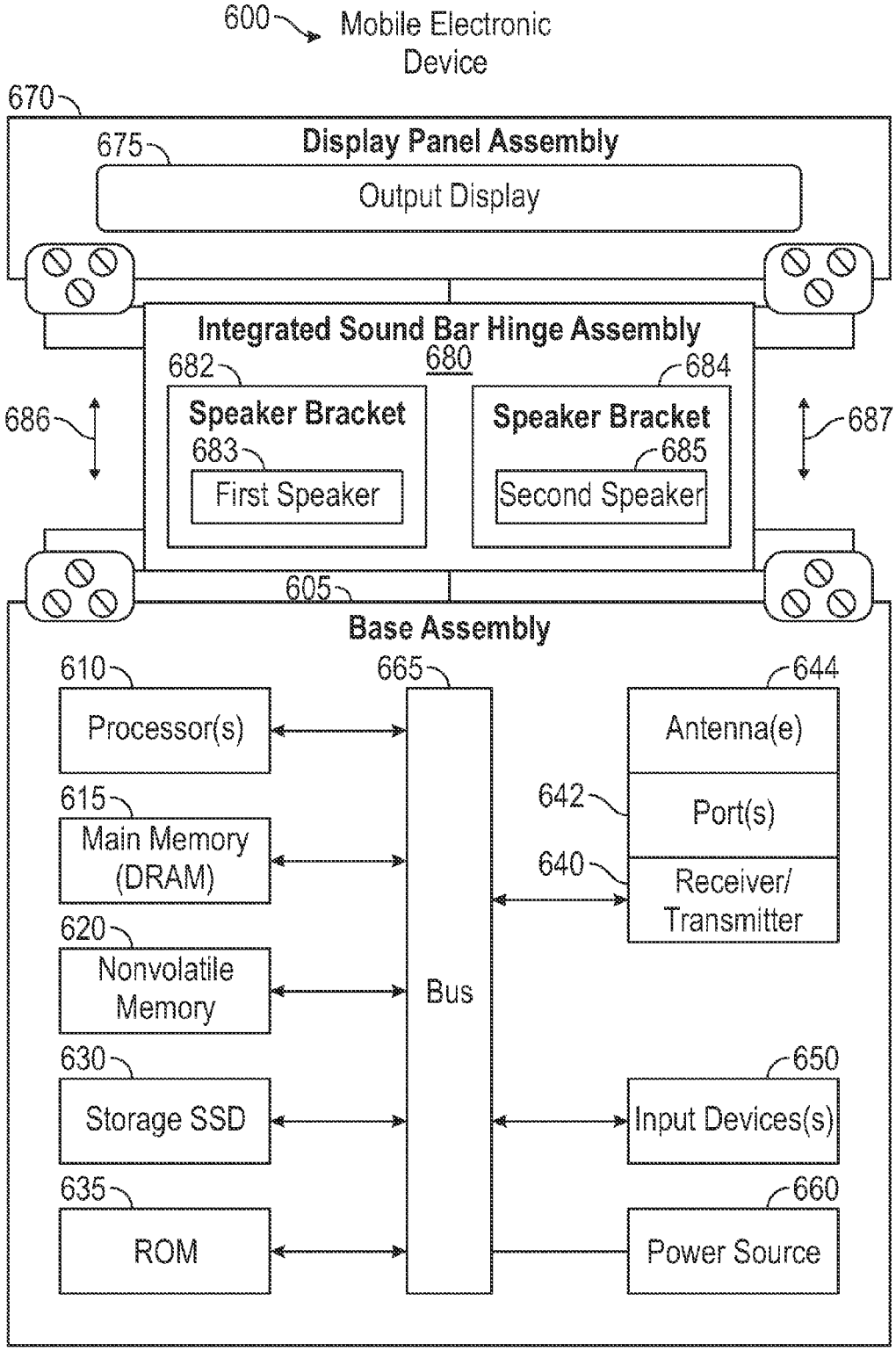
FIG. 6 is an illustration of an embodiment of a system including a sound bar hinge assembly according to an embodiment.

FIG. 6 is an illustration of an embodiment of a mobile electronic device including a sound bar hinge assembly according to an embodiment. In this illustration, certain standard and well-known components that are not germane to the present description are not shown. Elements shown as separate elements may be combined, including, for example, an SoC (System on Chip) combining multiple elements on a single chip.

In some embodiments, a mobile electronic device 600 includes a first portion, such as a base assembly 605, and a second portion such as display panel assembly 670 including output display 675, coupled together with an integrated sound bar hinge assembly 680. In some embodiments, the mobile electronic device 600 may be as illustrated in FIGS. 1A and 1B. FIG. 6 is intended to provide illustration of the components that may be included in the mobile electronic device 600, and is not intended to illustrate scale or construction detail for the illustrated components.

In some embodiments, the sound bar hinge assembly 680 includes a first speaker bracket 682, to which may be installed a first speaker 683, and a second speaker bracket 684, to which may be installed a second speaker 685. In some embodiments, the first speaker 683 and second speaker 685 operate as output devices for the mobile electronic device 600. In some embodiments, the sound bar hinge assembly further includes one or more hinge sets, such as a first hinge set 686 and a second hinge set 687, wherein the one or more hinge sets are to hingeably couple the base assembly 605 with the display panel assembly 670. In some embodiments, the sound bar hinge assembly 680 is electrically connected to at least one of the portions of the device 600, such as to the base assembly 605, by one or more cables, the base assembly 605 to provide audio signals to drive one or more speakers (683, 685) of the sound bar speaker assembly 680.

In some embodiments, the base assembly 605 may include a processing means such as one or more processors 610 coupled to one or more buses or interconnects, shown in general as bus 665. The processors 610 may comprise one or more physical processors and one or more logical processors. In some embodiments, the processors may include one or more general-purpose processors or special-processor processors.

The bus 665 is a communication means for transmission of data. The bus 665 is illustrated as a single bus for simplicity, but may represent multiple different interconnects or buses and the component connections to such interconnects or buses may vary. The bus 665 shown in FIG. 6 is an abstraction that represents any one or more separate physical buses, point-to-point connections, or both connected by appropriate bridges, adapters, or controllers.

In some embodiments, the base assembly 605 further comprises a random access memory (RAM) or other dynamic storage device or element as a main memory 615 for storing information and instructions to be executed by the processors 610. Main memory 615 may include, but is not limited to, dynamic random access memory (DRAM).

The base assembly 605 also may comprise a non-volatile memory 620; a storage device such as a solid state drive (SSD) 630; and a read only memory (ROM) 635 or other static storage device for storing static information and instructions for the processors 610.

In some embodiments, the base assembly 605 includes one or more transmitters or receivers 640 coupled to the bus 665. In some embodiments, the base assembly 605 may include one or more antennae 644, such as dipole or monopole antennae, for the transmission and reception of data via wireless communication using a wireless transmitter, receiver, or both, and one or more ports 642 for the transmission and reception of data via wired communications. Wireless communication includes, but is not limited to, Wi-Fi, Bluetooth™, near field communication, and other wireless communication standards.

In some embodiments, base assembly 605 includes one or more input devices 650 for the input of data, including hard and soft buttons, a joy stick, a mouse or other pointing device, a keyboard, voice command system, or gesture recognition system.

In some embodiments, the display panel assembly 670 includes an output display 675, where the display 675 may include a liquid crystal display (LCD) or any other display technology, for displaying information or content to a user. In some environments, the display 675 may include a touch-screen that is also utilized as at least a part of an input device 650.

The system 600 may also comprise a battery or other power source 660, which may include a solar cell, a fuel cell, a charged capacitor, near field inductive coupling, or other system or device for providing or generating power in the handheld device 605. The power provided by the power source 660 may be distributed as required to elements of the handheld device 605.

In the description above, for the purposes of explanation, numerous specific details are set forth in order to provide a thorough understanding of the described embodiments. It will be apparent, however, to one skilled in the art that embodiments may be practiced without some of these specific details. In other instances, well-known structures and devices are shown in block diagram form. There may be intermediate structure between illustrated components. The components described or illustrated herein may have additional inputs or outputs that are not illustrated or described.

Various embodiments may include various processes. These processes may be performed by hardware components or may be embodied in computer program or machine-executable instructions, which may be used to cause a general-purpose or special-purpose processor or logic circuits programmed with the instructions to perform the processes. Alternatively, the processes may be performed by a combination of hardware and software.

Portions of various embodiments may be provided as a computer program product, which may include a computer-readable medium having stored thereon computer program instructions, which may be used to program a computer (or other electronic devices) for execution by one or more processors to perform a process according to certain embodiments. The computer-readable medium may include, but is not limited to, magnetic disks, optical disks, compact disk read-only memory (CD-ROM), and magneto-optical disks, read-only memory (ROM), random access memory (RAM), erasable programmable read-only memory (EPROM), electrically-erasable programmable read-only memory (EEPROM), magnet or optical cards, flash memory, or other type of computer-readable medium suitable for storing electronic instructions. Moreover, embodiments may also be downloaded as a computer program product, wherein the program may be transferred from a remote computer to a requesting computer.

Many of the methods are described in their most basic form, but processes can be added to or deleted from any of the methods and information can be added or subtracted from any of the described messages without departing from the basic scope of the present embodiments. It will be apparent to those skilled in the art that many further modifications and adaptations can be made. The particular embodiments are not provided to limit the concept but to illustrate it. The scope of the embodiments is not to be determined by the specific examples provided above but only by the claims below.

If it is said that an element "A" is coupled to or with element "B," element A may be directly coupled to element B or be indirectly coupled through, for example, element C. When the specification or claims state that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification or claim refers to "a" or "an" element, this does not mean there is only one of the described elements.

An embodiment is an implementation or example. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. It should be appreciated that in the foregoing description of exemplary embodiments, various features are sometimes grouped together in a single embodiment, figure, or description thereof for the purpose of streamlining the disclosure and aiding in the understanding of one or more of the various novel aspects. This method of disclosure, however, is not to be interpreted as reflecting an intention that the claimed embodiments requires more features than are expressly recited in each claim. Rather, as the following claims reflect, novel aspects lie in less than all features of a single foregoing disclosed embodiment. Thus, the claims are hereby expressly incorporated into this description, with each claim standing on its own as a separate embodiment.

In some embodiments, an integrated sound bar hinge assembly includes a hinge assembly body; at least one hinge set coupled with hinge assembly body to hingeably couple a first portion of a mobile device to a second portion of the mobile device; and at least one speaker bracket contained in the hinge assembly body to install a first speaker.

In some embodiments, the integrated sound bar hinge assembly further includes a cable electrically connected to the at least one speaker bracket to provide an audio signal to an installed speaker.

In some embodiments, an axle of the at least one hinge assembly is hollow, and wherein the cable is to run through the hollow axle.

In some embodiments, the hinge assembly body includes a forward side, the at least one speaker bracket being located such that an installed speaker is oriented in a direction of the front side of the hinge assembly.

In some embodiments, an axle of each hinge of the at least one hinge set is enclosed at least in part by the hinge assembly body.

In some embodiments, a mobile electronic device includes a first portion; a second portion; and a hinge assembly to hingeably couple the first portion and the second portion, wherein the hinge assembly includes a hinge assembly body including a first side, a first end, and a second end, at least one hinge set coupled with hinge assembly body to hingeably couple a first portion of a mobile device to a second portion of the mobile device, and at least one speaker bracket in the hinge assembly body to connect a first speaker.

In some embodiments, the device further includes a cable electrically connected to the at least one speaker bracket to provide an audio signal to an installed speaker. In some embodiments, an axle of the at least one hinge assembly is hollow, and wherein the cable is to run through the hollow axle.

In some embodiments, an axle of each hinge of the at least one hinge set is enclosed at least in part by the hinge assembly body.

In some embodiments, the first portion and second portion have a front side and a back side, the hinge assembly body includes a first side that is in a same direction as the front sides of the first portion and the second portion, and the at least one speaker bracket being located such that an installed speaker faces the first side of the hinge assembly.

In some embodiments, at least one speaker bracket in the hinge assembly body is to face a user of the system when the device is in operation in a laptop computer position.

In some embodiments, the hinge assembly comprises a hinge synchronization bar for the mobile electronic device.

In some embodiments, a computing system includes a display assembly including a display screen; a base assembly including a processor; and an integrated sound bar hinge assembly to hingeably couple the display assembly and the base assembly, wherein the hinge assembly includes a hinge assembly body including a first side, a first end, and a second end, a first hinge set coupled with the first end of the hinge assembly body and a second hinge set coupled with the second end of hinge assembly body, the first hinge set and the second hinge set to hingeably couple the display assembly and the base assembly, and one or more speakers installed in the hinge assembly body.

In some embodiments, the system further includes one or more cables electrically connected to the one or more speakers and the base assembly, the base assembly to provide audio signals to the one or more speakers via the one or more cables. In some embodiments, an axle of at least one hinge set is hollow, and wherein at least one cable is to run through the hollow axle.

In some embodiments, an axle of each hinge of the first hinge set is enclosed at least in part in the first end of the hinge assembly body and an axle of each hinge of the second hinge set is enclosed at least in part in the second end of the hinge assembly body.

In some embodiments, the display assembly and base assembly each have a front side and a back side, the hinge assembly body includes a front side, and the one or more speakers are located in the front side of the hinge assembly.

In some embodiments, the one or more speakers face a user of the system when the system is in operation in a laptop computer position.

In some embodiments, the system is a convertible system, and wherein the one or more speakers are oriented in a side direction when the system is in a tablet computer position. In some embodiments, in the tablet computer position, audio is to be produced in a direction that is parallel to the front side of the display assembly.

In some embodiments, the hinge assembly comprises a hinge synchronization bar for the computer system.

In some embodiments, the display assembly and base assembly do not include a speaker or speaker bracket.

In some embodiments, a convertible device includes a display assembly including a display screen; a base assembly including a processor; and an integrated sound bar hinge assembly to hingeably couple the display assembly and the base assembly, wherein integrated sound bar hinge assembly enables positioning of the convertible device in a plurality of positions, wherein the integrated sound bar hinge assembly includes: a hinge assembly body including a first side, a first end, and a second end, a first hinge set coupled with the first end of the hinge assembly body and a second hinge set coupled with the second end of hinge assembly body, the first hinge set and the second hinge set to hingeably couple the display assembly and the base assembly, and one or more speakers installed in the hinge assembly body.

In some embodiments, the convertible device further includes one or more cables electrically connected to the one or more speakers and the base assembly, the base assembly to provide audio signals to the one or more speakers via the one or more cables.

In some embodiments, an axle of at least one hinge set is hollow, and wherein at least one cable is to run through the hollow axle.

In some embodiments, an axle of each hinge of the first hinge set is enclosed at least in part in the first end of the hinge assembly body and an axle of each hinge of the second hinge set is enclosed at least in part in the second end of the hinge assembly body.

In some embodiments, the display assembly and base assembly each have a front side and a back side, the hinge assembly body includes a front side, and the one or more speakers are located in the front side of the hinge assembly.

In some embodiments, the plurality of positions includes a laptop computer position, and the one or more speakers face a user of the system when the system is in operation in a laptop computer position.

In some embodiments, the plurality of positions includes a tablet computer position, and the one or more speakers are oriented in a side direction when the convertible device is in the tablet computer position.

In some embodiments, when the convertible device is in the tablet computer position, audio is to be produced in a direction that is parallel to the front side of the display assembly.

In some embodiments, the integrated sound bar hinge assembly comprises a hinge synchronization bar for the convertible device.

In some embodiments, the display assembly and base assembly do not include a speaker or speaker bracket.

What is claimed is:

1. An integrated sound bar hinge assembly for a mobile device comprising:

a hinge assembly body having a first end and a second end;

a first hinge set coupled with the first end of the hinge assembly body and a second hinge set coupled with the second end of the hinge assembly body, the first hinge set and the second hinge set to hingeably couple a first portion of a mobile device to a second portion of the mobile device, each of the first hinge set and second hinge set including a first hinge having a first axle and a second hinge having a second axle, the first axle and second axle of the first hinge set and the second hinge set being installed in and enclosed at least in part by the first end of the hinge assembly body and the second end of the hinge assembly body, respectively; and at least one speaker bracket contained in the hinge assembly body to install a first speaker;

wherein the hinge assembly body includes a forward side, the at least one speaker bracket being located such that an installed speaker is oriented in a direction of the front side of the hinge assembly; and wherein the integrated sound bar hinge assembly comprises a hinge synchronization bar for the mobile device, the hinge synchronization bar allowing for 360 degrees of rotation, wherein:

the first hinge of each of the first hinge set and the second hinge set is operable to rotate 180 degrees from a first closed position to a second fully open position while the second hinge of each hinge set is stationary to maintain an orientation of the integrated sound bar hinge assembly, and the second hinge of each hinge set is operable to rotate an additional 180 degrees to a third position.

2. The integrated sound bar hinge assembly of claim 1, further comprising:

a cable electrically connected to the at least one speaker bracket to provide an audio signal to an installed speaker.

3. The integrated sound bar hinge assembly of claim 2, wherein the axle of at least one hinge of at least one hinge set is hollow, and wherein the cable is to run through the hollow axle.

4. A mobile electronic device comprising:

a first portion;

a second portion; and an integrated sound bar hinge assembly to hingeably couple the first portion and the second portion;

wherein the integrated sound bar hinge assembly includes:

a hinge assembly body including a first side, a first end, and a second end, a first hinge set coupled with the first end of the hinge assembly body and a second hinge set coupled with the second end of the hinge assembly body, the first hinge set and the second hinge set to hingeably couple a first portion of a mobile device to a second portion of the mobile device, each of the first hinge set and second hinge set including a first hinge having a first axle and a second hinge having a second axle, the first axle and second axle of the first hinge set and the second hinge set being installed in and enclosed at least in part by the first end of the hinge assembly body and the second end of the hinge assembly body, respectively, and at least one speaker bracket in the hinge assembly body to connect a first speaker;

wherein the first portion and second portion have a front side and a back side, the front side of the hinge assembly body is in a same direction as the front sides of the first portion and the second portion, and the at least one speaker bracket being located such that an installed speaker faces the first side of the integrated sound bar hinge assembly; and wherein the integrated sound bar hinge assembly comprises a hinge synchronization bar for the mobile electronic device, the hinge synchronization bar allowing for 360 degrees of rotation, wherein:

the first hinge of each of the first hinge set and the second hinge set is operable to rotate 180 degrees from a first closed position to a second fully open position while the second hinge of each hinge set is stationary to maintain an orientation of the integrated sound bar hinge assembly, and the second hinge of each hinge set is operable to rotate an additional 180 degrees to a third position.

5. The device of claim 4, further comprising:

a cable electrically connected to the at least one speaker bracket to provide an audio signal to an installed speaker.

6. The device of claim 5, wherein the axle of at least one hinge of at least one hinge set is hollow, and wherein the cable is to run through the hollow axle.

7. The device of claim 4, wherein at least one speaker bracket in the hinge assembly body is to face a user of the system when the device is in operation in a laptop computer position.

8. A computing system comprising:

a display assembly including a display screen;

a base assembly including a processor; and an integrated sound bar hinge assembly to hingeably couple the display assembly and the base assembly;

wherein the integrated sound bar hinge assembly includes:

a hinge assembly body including a first side, a first end, and a second end, a first hinge set coupled with the first end of the hinge assembly body and a second hinge set coupled with the second end of the hinge assembly body, the first hinge set and the second hinge set to hingeably couple the display assembly and the base assembly, each of the first hinge set and second hinge set including a first hinge having a first axle and a second hinge having a second axle, the first axle and second axle of the first hinge set and the second hinge set being installed in and enclosed at least in part by the first end of the hinge assembly body and the second end of the hinge assembly body, respectively, and one or more speakers installed in the hinge assembly body;

wherein the display assembly and base assembly each have a front side and a back side, the hinge assembly body includes a front side, and the one or more speakers are located in the front side of the integrated sound bar hinge assembly; and wherein the integrated sound bar hinge assembly comprises a hinge synchronization bar for the computer system, the hinge synchronization bar allowing for 360 degrees of rotation, wherein:

the first hinge of each of the first hinge set and the second hinge set is operable to rotate 180 degrees from a first closed position to a second fully open position while the second hinge of each hinge set is stationary to maintain an orientation of the integrated sound bar hinge assembly, and the second hinge of each hinge set is operable to rotate an additional 180 degrees to a third position.

9. The system of claim 8, further comprising:

one or more cables electrically connected to the one or more speakers and the base assembly, the base assembly to provide audio signals to the one or more speakers via the one or more cables.

10. The system of claim 8, wherein an axle of at least one hinge of at least one hinge set is hollow, and wherein at least one cable is to run through the hollow axle.

11. The system of claim 8, wherein the one or more speakers face a user of the system when the system is in operation in a laptop computer position.

12. The system of claim 11, wherein the system is a convertible system, and wherein the one or more speakers are oriented in a side direction when the system is in a tablet computer position.

13. The system of claim 12, wherein, in the tablet computer position, audio is to be produced in a direction that is parallel to the front side of the display assembly.

14. The system of claim 8, wherein the display assembly and base assembly do not include a speaker or speaker bracket.

* * * * *